US006935247B2

(12) United States Patent
Schaefers et al.

(10) Patent No.: US 6,935,247 B2
(45) Date of Patent: Aug. 30, 2005

(54) VERSATILE WORKSTATION SYSTEM

(75) Inventors: Mark Schaefers, Muscatine, IA (US); Douglas M. Hunt, Muscatine, IA (US); Robert J. Glenn, II, Chicago, IL (US); Shawn O. Barrett, Des Plaines, IL (US); William C. Cesaroni, Glenview, IL (US)

(73) Assignee: HNI Technologies Inc., Muscatine, IA (US)

( * ) Notice: Subject to any disclaimer, the term of this patent is extended or adjusted under 35 U.S.C. 154(b) by 144 days.

(21) Appl. No.: 10/356,412

(22) Filed: Jan. 31, 2003

(65) Prior Publication Data

US 2004/0149178 A1 Aug. 5, 2004

(51) Int. Cl.[7] ..... A47B 37/00
(52) U.S. Cl. ..... 108/50.01
(58) Field of Search ..... 108/50.01, 50.02, 108/6.4, 2.6; 312/223.6, 223.3, 223.2, 223.1, 194, 195, 196

(56) References Cited

U.S. PATENT DOCUMENTS

| | | | | |
|---|---|---|---|---|
| 4,066,023 A | | 1/1978 | Hughes | |
| 4,112,859 A | | 9/1978 | Willenbacher | |
| 4,365,561 A | | 12/1982 | Tellier et al. | |
| 4,408,543 A | | 10/1983 | Griffin | |
| 4,640,199 A | | 2/1987 | Zigman | |
| 4,665,836 A | * | 5/1987 | Burr | 108/64 |
| 4,669,789 A | | 6/1987 | Pemberton | |
| 4,852,500 A | * | 8/1989 | Ryburg et al. | 108/50.01 |
| 5,118,172 A | | 6/1992 | Ugalde | |
| 5,120,117 A | | 6/1992 | Williams | |
| 5,199,773 A | | 4/1993 | Price, Jr. et al. | |
| 5,437,235 A | | 8/1995 | Randolph | |
| 5,480,224 A | | 1/1996 | Ugalde | |
| 5,666,887 A | | 9/1997 | Grabowski et al. | |
| 5,694,861 A | | 12/1997 | Laukamm-Josten | |
| 5,746,489 A | | 5/1998 | Moon | |
| 5,752,449 A | | 5/1998 | Simon et al. | |
| 5,758,934 A | | 6/1998 | Flutka et al. | |
| 5,765,315 A | | 6/1998 | Nagamitsu et al. | |
| 5,794,545 A | * | 8/1998 | McDaniel et al. | 108/64 |
| 5,862,761 A | | 1/1999 | Moore | |
| 5,971,508 A | * | 10/1999 | Deimen et al. | 108/50.02 |
| 5,988,076 A | * | 11/1999 | Vander Park | 108/50.02 |
| 5,988,077 A | * | 11/1999 | Balderi | 108/64 |
| 6,003,452 A | * | 12/1999 | Moore | 108/50.01 |
| 6,016,755 A | | 1/2000 | Trapani | |
| 6,029,580 A | * | 2/2000 | Alfonso et al. | 108/50.02 |
| 6,135,032 A | | 10/2000 | Ko | |
| 6,161,487 A | * | 12/2000 | Chang | 108/50.01 |
| 6,170,406 B1 | | 1/2001 | Klein et al. | |
| 6,170,410 B1 | | 1/2001 | Gioacchini et al. | |
| 6,202,567 B1 | | 3/2001 | Funk et al. | |
| 6,220,180 B1 | | 4/2001 | Janowitz | |
| 6,374,752 B1 | * | 4/2002 | Walser | 108/50.01 |
| 6,609,465 B2 | * | 8/2003 | Kolavo | 108/50.01 |

FOREIGN PATENT DOCUMENTS

| | | | | |
|---|---|---|---|---|
| GB | 2127682 A | * | 4/1984 | A47B/13/10 |
| JP | 06182236 A | * | 7/1994 | B01L/9/02 |

* cited by examiner

*Primary Examiner*—Jose V. Chen
(74) *Attorney, Agent, or Firm*—Joseph H. Golant; Jones Day

(57) ABSTRACT

A versatile workstation system including two tables which are removably connected to each other, the tables for supporting two computer monitors, two keyboards and two CPU units. One of the tables is at a standard height and may be used as a desk or a conference table. The second table is two inches lower. The second table is mounted on casters to allow it to be rolled up to and away from the first table. The second table includes brackets for connecting to the first table when the tables are adjacent one another. The second table also includes a wire management structure and has a computer support bracket for computer CPUs. The second table may be used to support the monitors, the CPUs and the keyboards as well as other equipment when the second table is rolled out of the way. The combination of the two tables provide versatility for an office space and is efficaciously ergonomic.

12 Claims, 7 Drawing Sheets

VERSATILE WORKSTATION SYSTEM

BACKGROUND OF THE INVENTION

CROSS REFERENCE TO RELATED APPLICATIONS

Not applicable.

STATEMENT RE FEDERALLY SPONSORED RESEARCH

Not applicable.

1. Field of the Invention

The present invention relates to a workstation and more particularly to a very versatile workstation having two movably connectable tables which come together depending on need.

2. Description of the Related Art

The workplace environment has been changing from one of enclosed offices to fixed cubicles, and more recently, to open spaces with movable furniture that allow workstations to be created as a need arises.

The art is replete with examples of tables or desks having computers including the following U.S. Pat. Nos.: 6,220,180; 6,202,567; 6,170,410; 6,003,452; 5,862,761; 5,765,315; 5,666,887; 4,408,543; 4,365,561; 4,112,859; and 4,066,023.

Unfortunately, none of these references provide the versatility needed in today's office environment.

BRIEF SUMMARY OF THE INVENTION

The versatility absent from the earlier art has been provided by the present invention. What is described here is a versatile workstation system comprising a first table having an upper work surface disposed at a first height from a floor upon which the table is supported and a second table having an upper work surface disposed at a second height from the floor, the second table having a computer support structure extending from a bottom surface and the second table being mounted to wheels, where the first and second tables are removably connected to each other and the second table is movable from a connected position to a distant disconnected position.

There are a number of advantages, features and objects achieved with the present invention which are believed not to be available in earlier related devices. For example, major advantages are that the present invention provides a versatile workspace and allows a user to use one table as a desk or conference table or, with the second table, as a computer station. The computer station is created by simply rolling up the second table which is carrying one or two CPUs, one or two monitors and one or two keyboards. The computer workstation in conjunction with the first mentioned table may support either one or two people. Another feature of the present invention is that the two table workstation is simple, inexpensive and easily arranged.

A more complete understanding of the present invention and other objects, advantages and features thereof will be gained from a consideration of the following description of a preferred embodiment read in conjunction with the accompanying drawing provided herein. The preferred embodiment represents an example of the invention which is described here in compliance with Title 35 U.S.C. section 112 (first paragraph), but the invention itself is defined by the attached claims.

DETAILED DESCRIPTION OF A PREFERRED EMBODIMENT OF THE INVENTION

Figure 1:
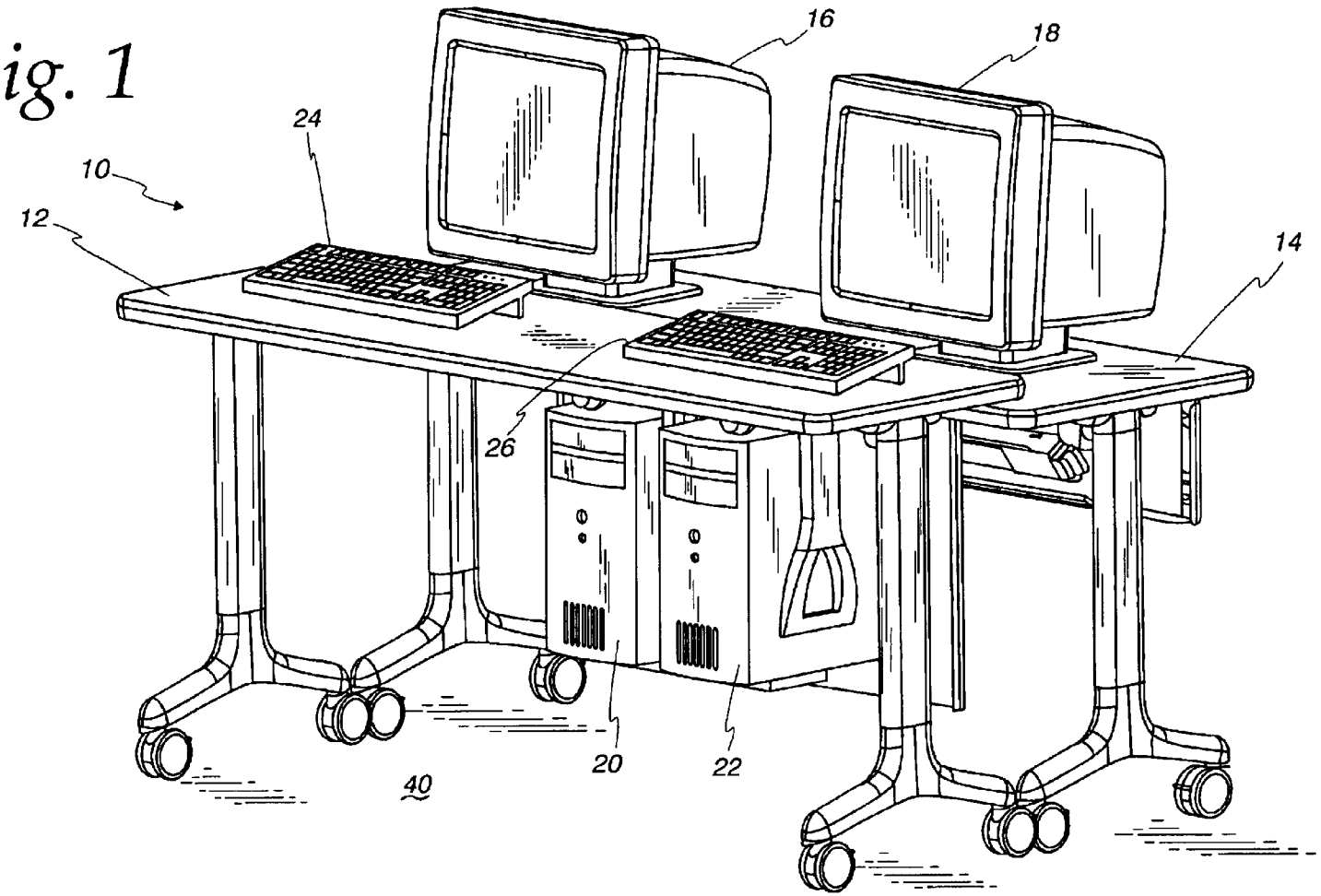
FIG. 1 is an isometric view of the versatile computer workstation disclosed here having front and rear tables.
Figure 3:
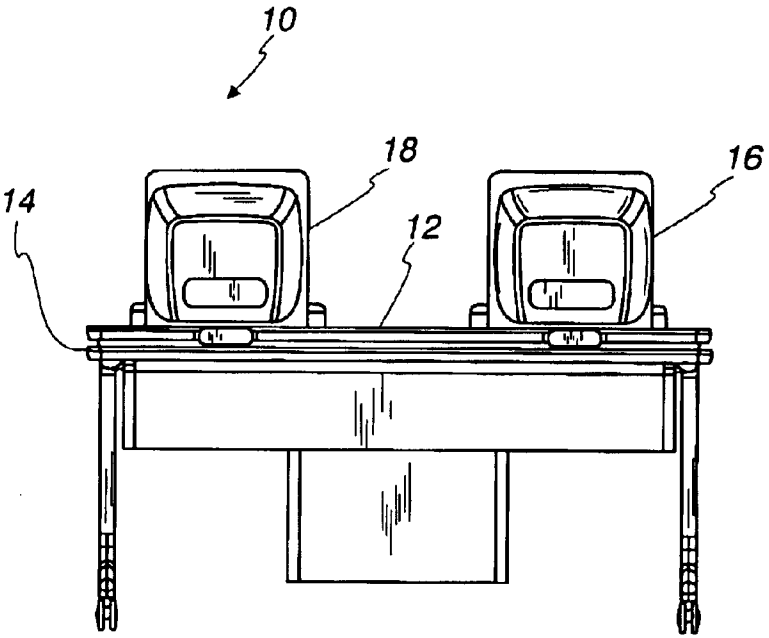
FIG. 3 is a rear elevation view of the workstation shown in FIGS. 1 and 2.
Figure 2:
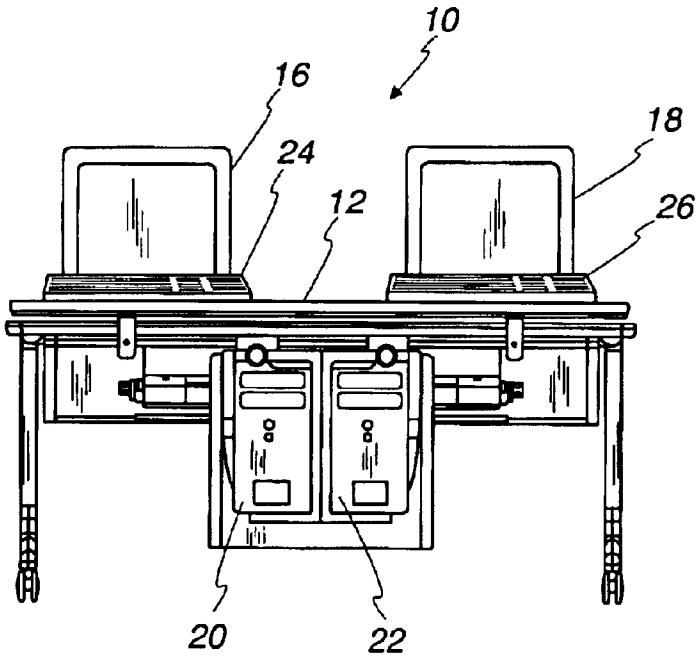
FIG. 2 is a front elevation view of the workstation shown in FIG. 1.

While the present invention is open to various modifications and alternative constructions, the preferred embodiment shown in the various figures of the drawing will be described herein in detail. It is understood, however, that there is no intention to limit the invention to the particular embodiment, form or example disclosed. On the contrary, the intention is to cover all modifications, equivalent structures and methods, and alternative constructions falling within the spirit and scope of the invention as expressed in the appended claims, pursuant to Title 35 U.S.C. section 112 (second paragraph).

The simplicity and versatility of the workstation system disclosed here may be understood by referring now to FIGS. 1–6. The workstation 10 includes a first or front table 12 and a second or rear table 14. The rear table 14 is movable between a connected position as shown in FIGS. 1–6 and a separated position where the rear table may be disconnected from the front table and moved to a storage area or an out-of-the-way position distant from the first table.

Supported by the second table 14 are two computer monitors 16, 18 and two CPUs 20, 22. Computer keyboards 24, 26 are positioned on the front table 12 which may also support a mouse (not shown) for each of the computers. In the arrangement shown in FIGS. 1–6, the workstation system provides two computer stations for up to two users.

Figure 7:
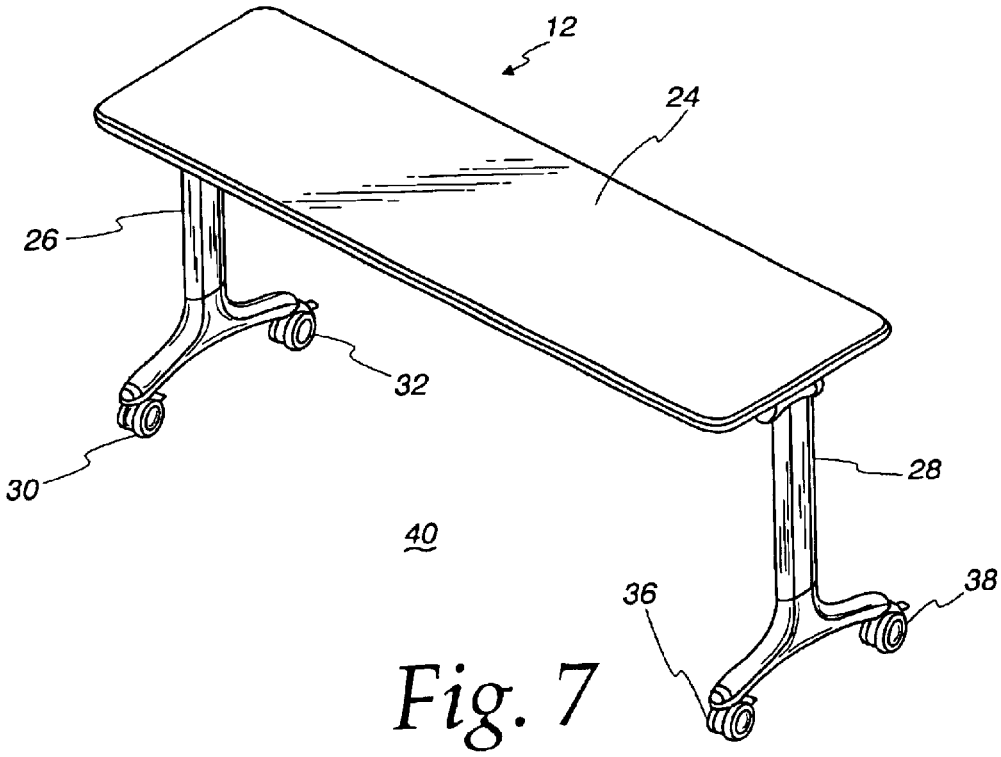
FIG. 7 is an isometric view of the front table of the workstation shown in FIGS. 1–6.
Figure 8:
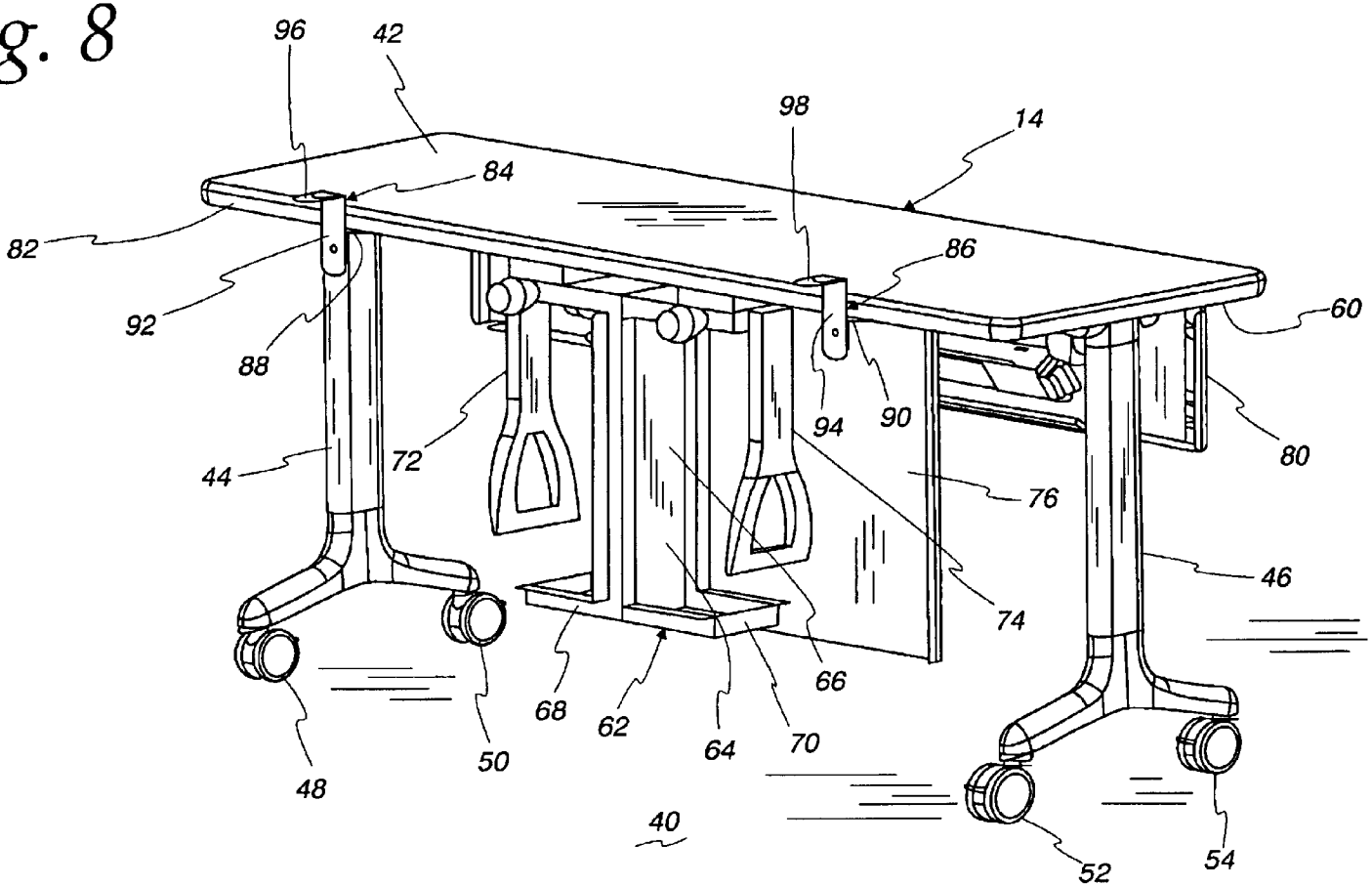
FIG. 8 is an isometric view of the rear table of the workstation shown in FIGS. 1–6.
Figure 9:
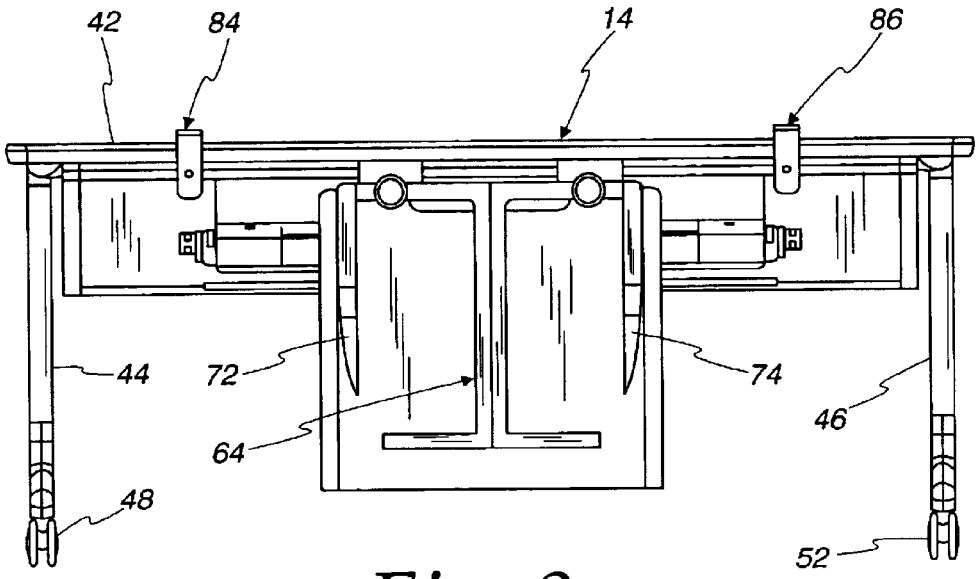
FIG. 9 is a front elevation view of the table shown in FIG. 8.
Figure 10:
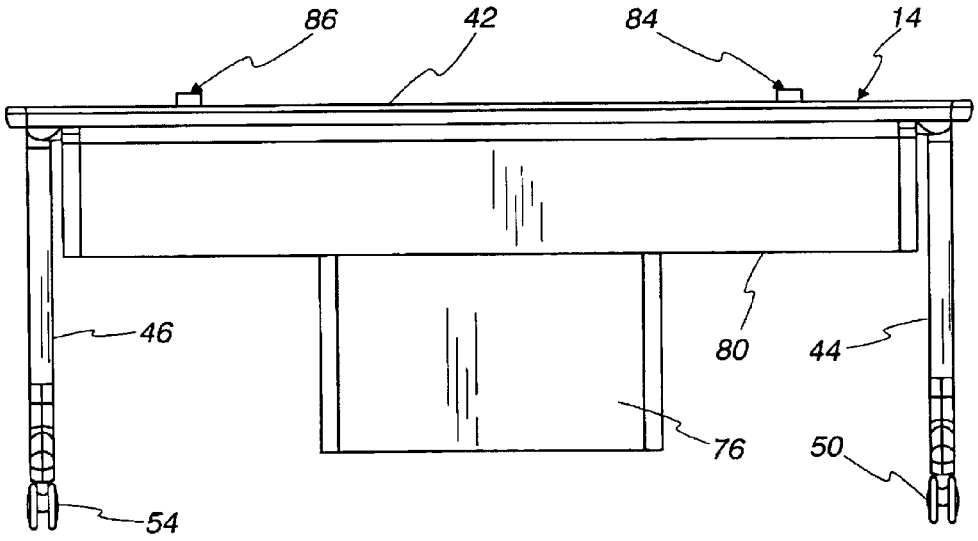
FIG. 10 is a rear elevation view of the table shown in FIGS. 8 and 9.
Figure 11:
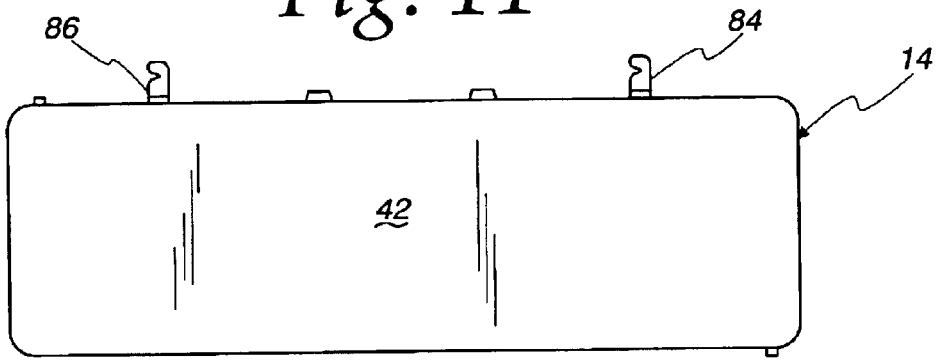
FIG. 11 is a top plan view of the table shown in FIGS. 8–10.
Figure 12:
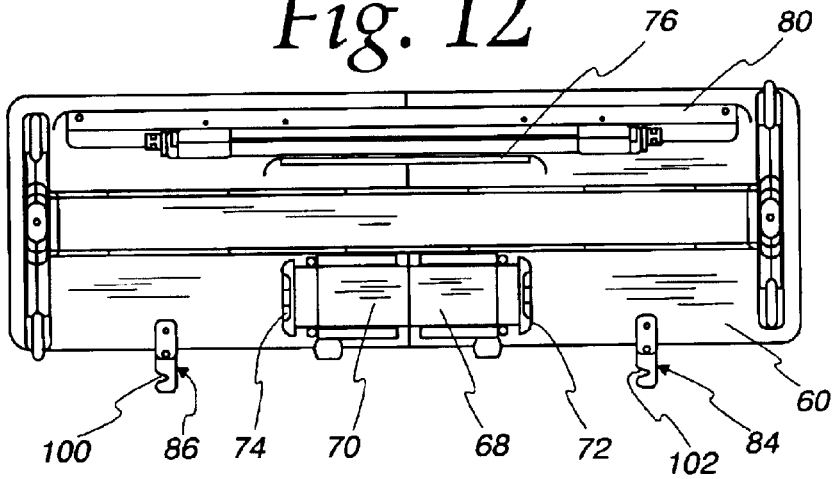
FIG. 12 is a bottom plan view of the table shown in FIGS. 8–11.
Figure 13:
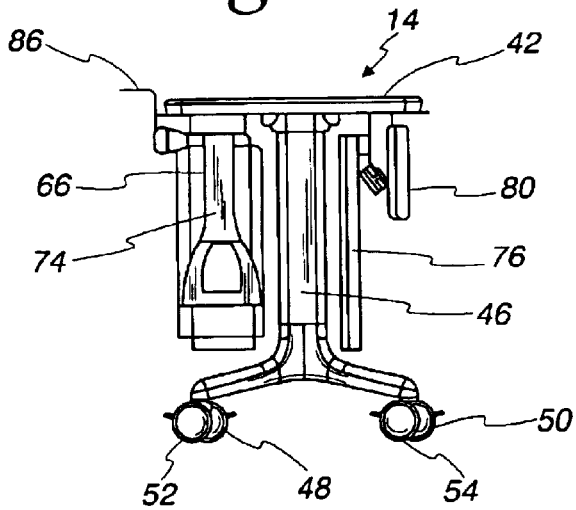
FIG. 13 is a side elevation view of the table shown in FIGS. 8–12.

The front table 12 is shown without any computer equipment in FIG. 7. The front table includes an upper work surface or panel 24, two depending legs 26, 28 and a set of four casters 30, 32, 36, 38.

The front table 12 is constructed to stand at a first height which typically is about 27 inches above a floor 40 on which the table stands. At that height, the table may be used as a desk or as a conference table or both depending upon need. A more detailed description of the table is provided in a co-pending application owned by the assignee of the present application, Ser. No. 10/284,678 entitled "A Folding And Tilting Table". This co-pending application is incorporated herein by reference. The above identified application describes a table which may be tilted and/or folded so that it may be set aside for short or long term storage. These features add to the versatility of the workstation system disclosed here. It should be understood that a non-folding, non-tilting table may also be used if desired.

The rear table 14 is illustrated in more detail in the FIGS. 8–13. Like the front table 12, the rear table 14 includes an upper work surface or panel 42, a pair of legs 44, 46 and a set of rotating structures, such as casters 48, 50, 52, 54. The casters allow the rear table to be easily and conveniently moved. The height of the rear table 14 is different from the height of the front table by about two inches, such that the height of the rear table is about 25 inches from the floor 40 on which the tables are supported. As will be discussed, the shorter dimension of the rear table places the computer monitors 16, 18, FIG. 1, at a more ergonomically correct level.

The rear table 14 includes a bottom surface 60 from which extends a computer support structure 62. The computer support structure includes an inverted T-shaped bracket 64. The T-shaped bracket includes a vertical stem 66 and two horizontal arms 68, 70. Laterally spaced from the stem 66 are two vertically extending arms 72, 74 that parallel the stem 66. As shown in FIG. 1, the T-shaped bracket 64 and the arms 72, 74 are designed to support the two side-by-side CPUs 20, 22.

The rear table also includes a downwardly extending modesty panel 76 which is spaced rearwardly of the computer support structure 62 to hide the CPUs from an observer standing to the rear of the workstation system. Further rearwardly of the modesty panel is a wire management structure 80 for organizing and concealing the various electrical and data transmission wires, cords, cables and the like which invariably attend a computer.

Figure 5:
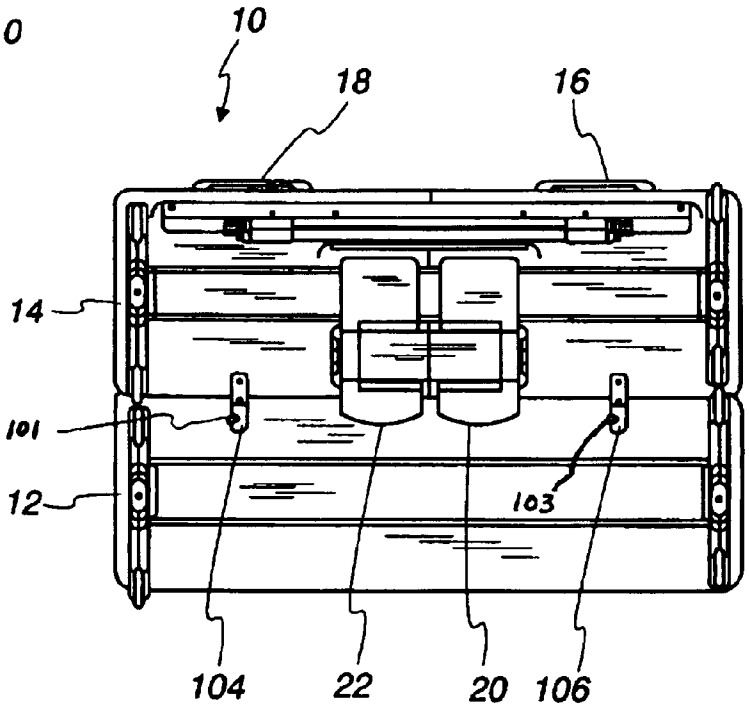
FIG. 5 is a bottom plan view of the workstation shown in FIGS. 1–4.
Figure 4:
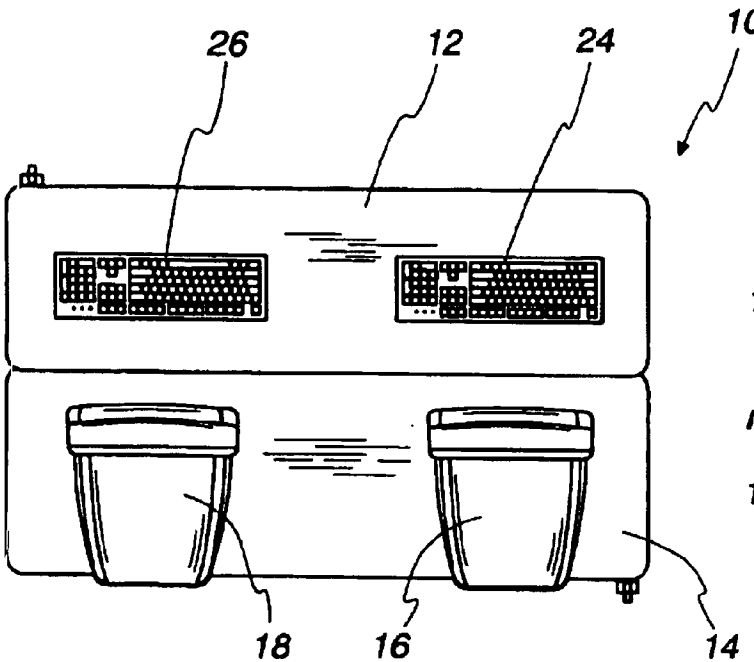
FIG. 4 is a top plan view of the workstation shown in FIGS. 1–3.
Figure 6:
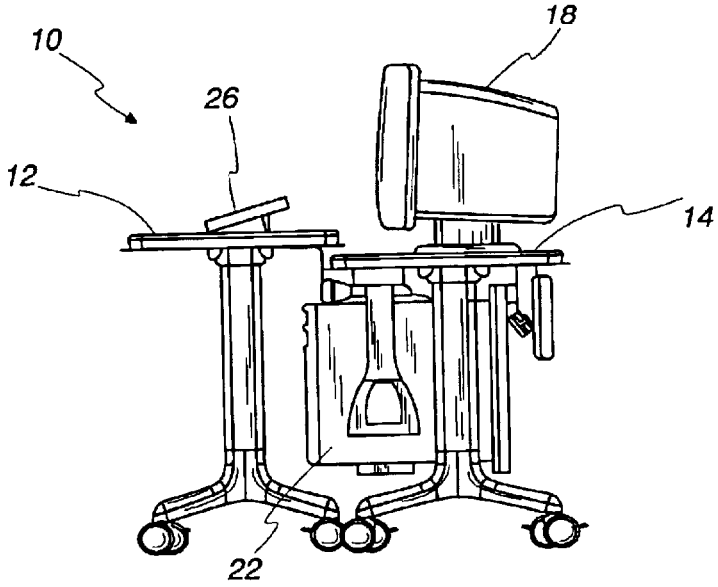
FIG. 6 is a side elevation view of the workstation shown in FIGS. 1–5.

Attached at the forward edge 82 of the rear table 14 are a pair of connector brackets 84, 86 which are used to engage the rear table to the front table when the two are in their connected position such as shown in FIG. 1. The connector brackets may each include a horizontal arm 88, 90 which is fastened to the bottom surface 60 of the rear table, vertical arm 92, 94 to position the bracket above the upper work surface 42 of the rear table and a horizontally extending arm 96, 98 with a screw or pin receiving slot 100, 102. The pins 101, 103, connected to the front table, are illustrated in FIG. 5.

The operation of the workstation system is simple, easy and quickly accomplished. For example, the workstation system is shown in its operational mode in FIG. 1 where two computers are supported on the front and rear tables to accommodate up to two users. The computer monitors and CPUs are supported by the rear table and the keyboards and mice are supported by the front table. In this mode or position the tables are adjacent each other with the connector brackets 84, 86 of the rear table engage with the pins 104, 106 of the front table. The engagement simply requires that the two table to be brought together and for either of the tables to be moved laterally to allow engagement of the pins and the connector brackets. The higher front table and lower rear table provide excellent ergonomics for the users when the computers are being operated.

The tables are easily and quickly disengaged simply by moving the tables laterally to each other so as to disengage the pins and connector brackets after the keyboards and mice are placed on the rear table. Thereafter, the rear table may be rolled to a storage position or a position at an unobtrusive location. Since all of the equipment and electrical cords are carried by the rear table, there need be no disconnection or disassembly of equipment other than perhaps an unplugging of the main electrical cord from a socket near the front table. Of course, if the rear table is not moved far, a long cord may remain plugged into the socket whether the tables are in connected mode or disconnected mode. This allows for a easy and quick disengagement of the two tables to allow the front table to be used as a desk or conference table without interference from computer equipment. In a conference table mode other chairs may be brought up to all sides of the table without any hindrance from equipment or wires, cords or the like.

When there is a need for the users to operate the computers, the two tables may be easily brought together and engaged. As can be appreciates, this may also be done easily, simply and quickly.

The above specification describes in detail the preferred embodiment of the present invention. Other examples, embodiments, modifications and variations will, under both the literal claim language and the doctrine of equivalents, come within the scope of the invention defined by the appended claims. For example, changing the absolute or relative heights of the two table are considered equivalent structures and will also come within the literal language of the claims. Also having a front table without wheels will come within the literal language of the claims as will tables with different shapes or design features. Still other alternatives will also be equivalent as will many new technologies. There is no desire or intention here to limit in any way the application of the doctrine of equivalents nor to limit or restrict the scope of the invention.

What is claimed is:

1. A versatile workstation system comprising:

a first table having an upper work panel disposed at a first height from a floor on which the system is supported;

a second table having an upper work panel disposed at a second height from the floor, said second height is lower than said first height, said second table having a computer support structure extending from a bottom surface of said upper work panel, and said second table being mounted to rotating structures; and said first and second tables being removably connected to each other wherein said second table is removable from a connected position to a spaced away disconnected position, and wherein said upper work panel of said first table supports two computer keyboards when said first and said second tables are connected and said upper panel of said second table supports two computer monitors.

2. A versatile workstation system comprising:

a first table having an upper work panel disposed at a first height from a floor on which the system is supported;

a second table having an upper work panel disposed at a second height from the floor, said second table having a computer support structure extending from a bottom surface of said upper work panel, said computer support structure including an inverted T-shaped bracket and two spaced apart side arms, said second table being mounted to rotating structures; and said first and said second tables being removably connected to each other wherein said second table is movable from a connected position to a spaced away disconnected position.

3. The apparatus as claimed in claim 2 wherein:

said computer support structure includes an extending panel spaced from said inverted T-shaped bracket.

4. A versatile workstation system comprising:

a first table having an upper work panel disposed at a first height from a floor on which the panel is supported;

a second table having an upper work panel disposed at a second height from the floor, said second height is lower than said first height, said second table having a computer support structure extending from a bottom surface of said upper work panel, said computer support structure including an inverted T-shaped bracket and two spaced apart side arms, and said second table being mounted to rotating structures; and said first and said second tables being removably connected to each other wherein said second table is movable from a connected position to a spaced away disconnected position.

5. The apparatus as claimed in claim 4 wherein:

said computer support structure includes an extending panel spaced from said inverted T-shaped bracket.

6. The apparatus as claimed in claim 5 including:

a wire management structure connected to one of said first or said second tables.

7. The apparatus as claimed in claim 6 wherein:

said wire management structure is connected to said second table.

8. The apparatus as claimed in claim 7 wherein:

said wire management structure is connected to said bottom surface of said second table spaced from the connection of said second table to said first table.

9. The apparatus as claimed in claim 8 wherein:

said upper work panel of said first table supports two computer keyboards when said first and said second tables are connected and said upper work panel of said second table supports two computer monitors.

10. A workstation system comprising:

a first table having an upper work panel; and a second table having an upper work panel for cooperating with said first table, said second table having a computer support structure extending from the bottom surface of said upper work panel, said computer support structure including an inverted T-shaped bracket.

11. The workstation system as claimed in claim 10 wherein:

said computer support structure includes two spaced apart side arms.

12. The workstation system as claimed in claim 11 wherein:

said computer support structure includes a vertically extending back panel.

* * * * *